United States Patent [19]

Marzoli

[11] Patent Number: 4,757,679

[45] Date of Patent: Jul. 19, 1988

[54] METHOD AND APPARATUS FOR AUTOMATICALLY DOFFING COPS AND REPLACING THEM WITH EMPTY TUBE IN A ROVING FRAME

[75] Inventor: Pietro B. Marzoli, Bergamo, Italy

[73] Assignee: Fratelli Marzoli & C. S.p.A., Bergamo, Italy

[21] Appl. No.: 7,515

[22] Filed: Jan. 28, 1987

[30] Foreign Application Priority Data

Jan. 28, 1986 [IT] Italy ..... 19199 A/86

[51] Int. Cl.[4] ..... D01H 9/08; D01H 9/10

[52] U.S. Cl. ..... 57/267; 57/268; 57/270; 57/274

[58] Field of Search ..... 57/266, 267, 268, 270, 57/275, 274

[56] References Cited

U.S. PATENT DOCUMENTS

| | | | |
|---|---|---|---|
| 1,823,374 | 9/1931 | Porter | 57/267 |
| 3,935,699 | 2/1976 | Iida et al. | 57/267 |
| 3,990,222 | 11/1976 | Marzoli | 57/267 |
| 4,313,299 | 2/1982 | Gunkinger et al. | 57/267 |
| 4,369,621 | 1/1983 | Kogiso | 57/267 |
| 4,389,840 | 6/1983 | Briner et al. | 57/267 |

*Primary Examiner*—John Petrakes

*Attorney, Agent, or Firm*—Diller, Ramik & Wight

[57] ABSTRACT

A doffing carriage is mobile at the level of the flyer support bed of a roving frame, and carries cop and empty tube gripping elements which are orientatable between a vertical position and an oblique position. A peg conveyor loaded with empty tubes in a reverse zig-zag arrangement to that of the cop rotators is disposed at the level of a footboard. The cops, lowered on to an orientatable cop carrier, are gripped by the gripping elements in an oblique position, raised, disposed vertically and deposited on to the free pegs of the conveyor, proceeding from one end of the roving frame to the other. After moving the conveyor through one step, the gripping elements deposit the empty tubes on to the cop rotators by proceeding in the reverse direction. The same carriage loads the empty tubes on to the conveyor and unloads the cops from it at one end of the roving frame, while this latter is in operation.

25 Claims, 10 Drawing Sheets

1
2
3
4
5
6
7
8
9
10
11
12
13
14
15
16
17
18
19
20
21
22
23
25
26
28
29
31
32
33
34
35
36
37
38
39
42
43
46
50
51
52
53
54
55

METHOD AND APPARATUS FOR AUTOMATICALLY DOFFING COPS AND REPLACING THEM WITH EMPTY TUBE IN A ROVING FRAME

This invention relates to a method and apparatus for automatically doffing cops and replacing them with empty tubes in a roving frame.

On termination of roving winding, the cops completely wound with the roving have to be removed from the cop rotator and replaced with empty tubes in order to continue the winding.

Now in contrast to cops wound on conventional roving frames, in which the weight of each cop complete with roving does not exceed 1500 grams, the cops currently formed on roving frames of new design, which have a very high production speed (up to 50% more than conventional frames) can exceed 3000 grams. It can be understood that removing cops of this weight involves heavy work for the operators.

For this reason and to reduce production costs, it has therefore been proposed to automate cop doffing and replacement. An automatic doffing apparatus is known from U.S. Pat. No. 4,369,621. In this apparatus the full cops are firstly lowered in their axial direction, together with the cop rotator support, so that they become released from the twisting unit (flyer). The lowered cops are then gripped by fork-shaped gripping devices, one for each cop, which extend substantially horizontally and are arranged to grip the cops at their suitably shaped upper end.

The gripping devices are disposed on a pantograph structure positioned to the front of the roving frame, and are mobile horizontally so as to move the cops parallel to themselves and deposit them on a peg-type conveyor, which is also disposed to the front of the machine between the pantograph structure and the machine itself.

The pegs are provided in two rows along the conveyor, and the cops to be doffed, which are gripped alternately in a zig-zag formation in accordance with the arrangement of the machine working positions, are disposed in zig-zag formation on the conveyor. The empty tubes are already disposed in a reverse zig-zag formation on the free pegs, and after moving the conveyor through one step parallel to the machine, they are gripped by the gripping devices and moved on to the cop rotators in place of the complete cops which have just been removed, these latter then being conveyed to a predetermined position for storage.

This apparatus has various drawbacks. It is of considerable bulk both in length and width in front of the machine, and thus hinders the operator who is required to supervise the normal operation of the machine and to intervene for example for rejoining any broken rovings.

Moreover, the gripping devices of this apparatus require the use of special tubes provided at their top with a projection so that the tubes (and cops) can be gripped, this involving increased costs.

The mechanisms and construction of this apparatus are relatively complicated, and result in high investment and maintenance costs. It should also be noted that the act of loading the cops on to the conveyor and unloading the tubes from the conveyor and moving them to the machine requires the conveyor to undergo corresponding movements in order to enable the cops of the outer row to pass into the empty spaces between the tubes, and to allow the tubes of the outer row to pass into the empty spaces between the cops respectively. This creates movement synchronisation problems which tend to making the apparatus more complicated and delicate.

A doffing apparatus which does not comprise gripping devices for lifting the cops is known from U.S. Pat. No. 4,023,338. In this apparatus the cops completely full of roving are released from the flyers by a mechanism which either moves the cop carrier downwards or the flyer support bed upwards. Another mechanism releases the cops by moving them axially upwards in order to disengage them from their operating means (cop rotator) and conveys them in a longitudinal direction to the outside of the roving frame and into a storage position.

After the aforesaid doffing operations have been completed, the empty tubes are fed to their respective positions immediately above the corresponding cop rotators using the transfer mechanism. The empty tubes are then engaged in the cop rotators and positioned for the twisting and winding operation.

This apparatus has the advantage that the space to the front of the roving frame is free, but has the disadvantage of using complicated mechanisms which require the apparatus to be very delicately and accurately adjusted for movement synchronism, especially when the empty tubes are returned to their working position in the corresponding cop rotators ready to receive the roving for the next formation.

A further drawback of this apparatus is that in the case of any fault, especially in the conveying mechanism for repositioning the empty tubes, the roving frame cannot be started again until the fault has been repaired, with serious economical damage in that the subsequent machines cannot be fed, with a resultant considerable production loss.

The main object of the present invention is to obviate the drawbacks and limitations of known doffing apparatus for roving frames, by providing a method and apparatus which allow the cops to be automatically doffed and replaced while keeping the machine face free for any required intervention by the operator during normal production, and do not require the use of complicated structural means or the use of cops of special type. This object is attained according to the invention by a method for automatically doffing cops and replacing them with empty tubes in a roving frame, of the type in which the cops are lowered into a position external to the flyers and conveyed on to the pegs of a conveyor in a zig-zag arrangement, the conveyor then being moved through a certain distance, and the empty tubes, which have been previously loaded on to them in positions intercalated with the cops, being withdrawn and conveyed on to the lowered cop carrier, this then being raised into its working position, characterised in that the lowered cops are orientated and raised obliquely from their lowered position, realigned vertically and then placed on the conveyor, and the empty tubes are raised form the conveyor, orientated and lowered obliquely on to the cop carrier, and then realigned with the axis of rotation of the cop rotators.

Advantageously, with such a method it is possible to keep the zone in front of the machine free, with the doffing action essentially upwards and downwards, the loading of the empty tubes on to the cop rotators also being done with essentially raising and lowering movements without requiring additional movements of the conveyor during doffing or during loading.

In order to implement the method according to the invention, an apparatus is proposed for automatically doffing cops and replacing them with empty tubes in a roving frame, comprising a device for gripping and conveying the cops and tubes, and a conveyor for receiving the cops and the empty tubes in respective intercalated zig-zag arrangements, means for lowering the cop carrier to the outside of the flyers into a position in which the cops are gripped, and means for the programmed movement of the conveyor, characterised in that the cop and tube gripping device comprises a carriage mobile along the face of the machine substantially at the level of the flyer support bed, and means on the carriage for obliquely gripping the cops positioned obliquely on the lowered inclined cop carrier, orientating them into a vertical position and depositing them on the conveyor, and for gripping the empty tubes from the conveyor and depositing them obliquely on the inclined cop carrier, the conveyor being disposed at the level of a machine footboard adjacent to the lowered cop carrier.

With an apparatus of this kind there is limited obstruction in the zone to the front of the roving frame, in that only the conveyor occupies any space, this corresponding substantially to the footboard of conventional roving frames, so that the operator is able to intervene easily for rejoining broken roving or for other reasons.

The construction and the various mechanisms are simpler than in known apparatus, with the result that maintenance is reduced. The single carriage for doffing and replacing the cops is not only able to progressively doff and replace the cops, but also able to load the empty tubes on to the conveyor in the correct position and to unload the cops from the conveyor to a storage container, this all being done while the machine is in operation, with increase in yield and substantial economical advantage. Advantageously, the gripping device can comprise a plurality of gripping means which can be of the type described in U.S. patent application Ser. No. 7,513, filed Jan. 28, 1987, of the present applicant, and can be inserted from above into the tubes and engaged therewith by expansion. It is therefore possible to use normal rather than special tubes for winding the roving, thus attaining cost reduction.

The cop gripping device of the aforesaid type also enables a greater number of cops to be loaded into a container trolley of given dimensions, as the trolley can be moved rearwards while the gripping device is still holding the cops, to thus load more cops into the container trolley, with further cost reduction. If the apparatus develops a fault, the roving frame can continue to operate, as the cops can be doffed manually without any obstruction by the apparatus.

Further characteristics of the invention will be apparent from the description given hereinafter with reference to the accompanying drawings, which show a preferred embodiment of the invention, it being however understood that the invention can also be implemented in various other forms.

Figure 1:
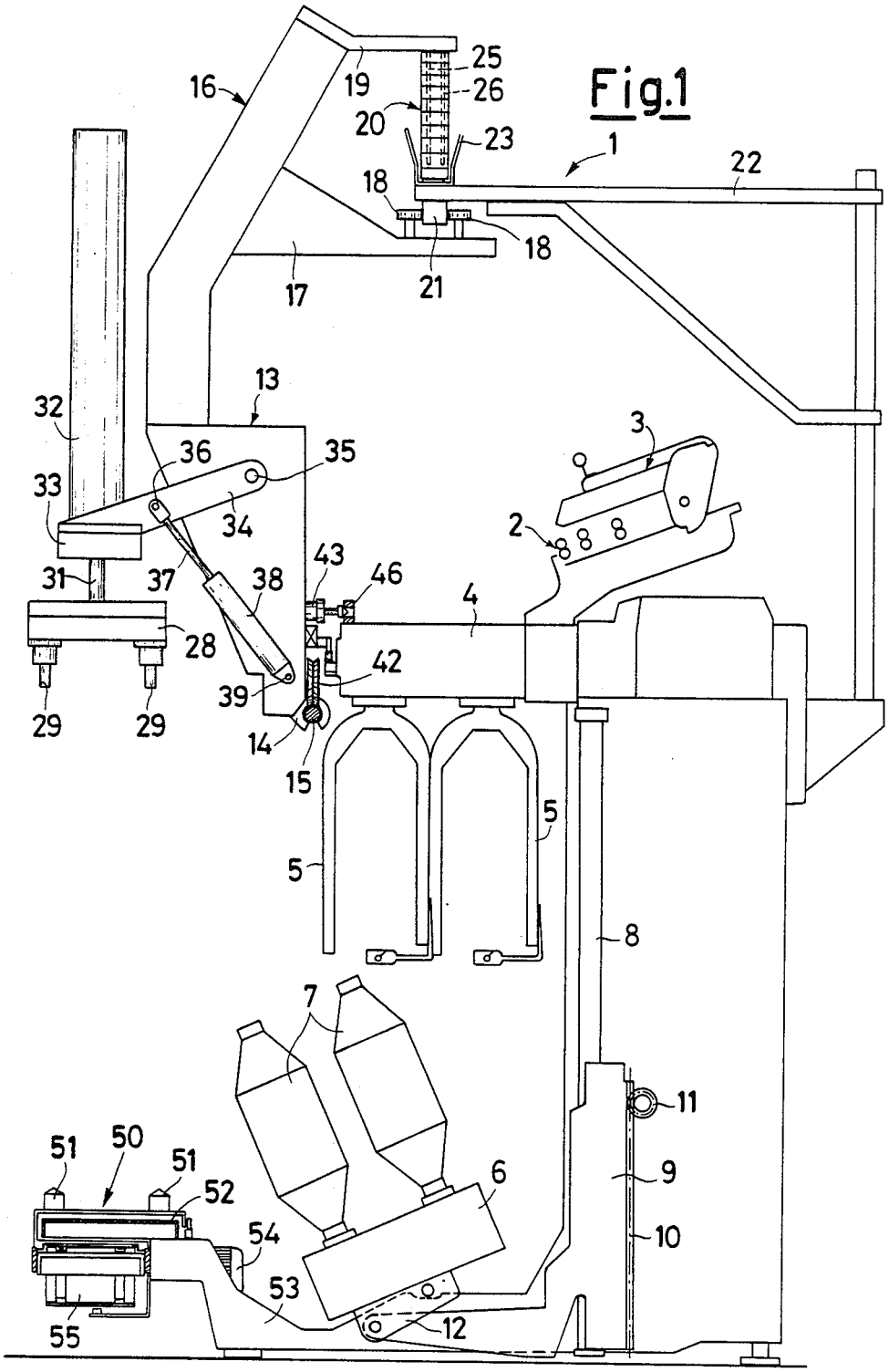
FIG. 1 is a diagrammatic side view of a roving frame provided with an apparatus according to the invention.
Figure 3:
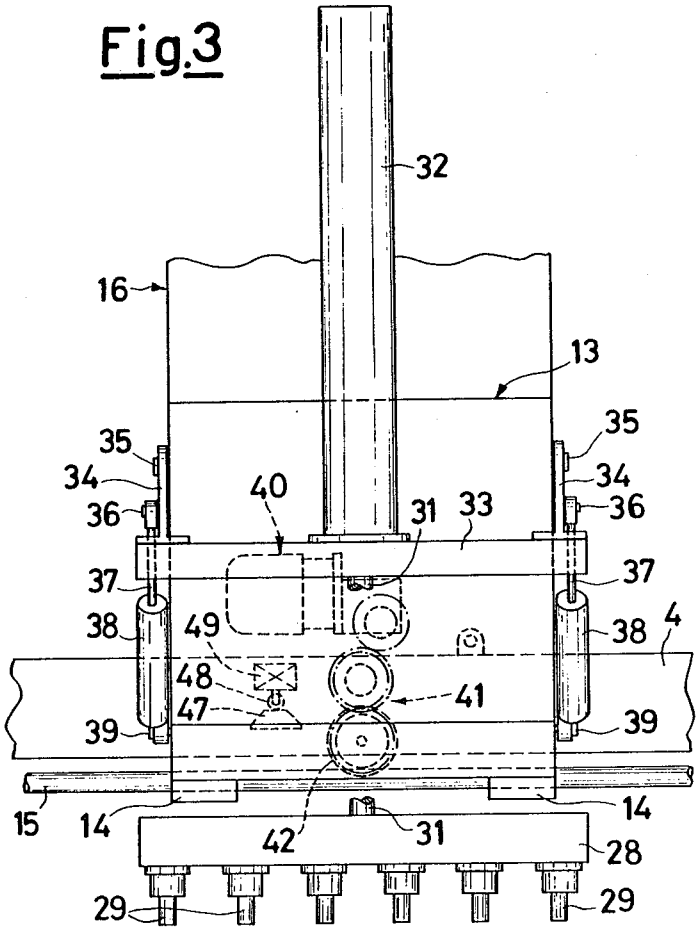
FIG. 3 is a diagrammatic front view of the doffing carriage.
Figure 2:
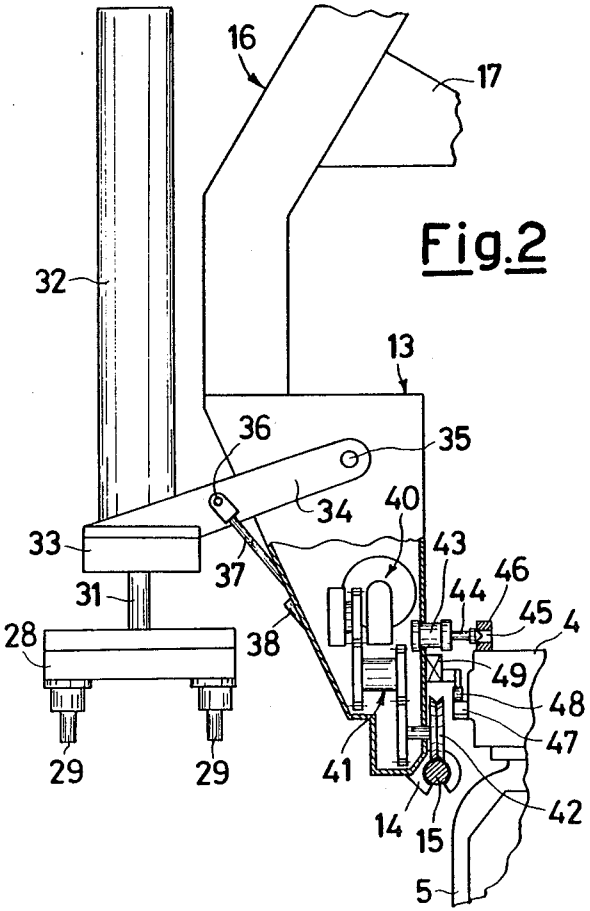
FIG. 2 is a detail of FIG. 1 to an enlarged scale.

The roving frame 1 shown by way of example comprises substantially, in known manner, a silver drawing unit 2 with its pressure arm 3, a bed 4 carrying the flyers 5 and a cop carrier 6 on which the cops 7 are prepared. The cop carrier 6 is mobile vertically by means of guides 8 fixed to the machine, and on which a support structure 9 for the carrier 6 is slidable in such a manner that the cops 7 can be moved outside the area in which they would interfere with the flyers 5, to allow doffing. The carrier 6 is moved by a rack 10 and pinion 11. The carrier 6 can also be orientated by an articulated system 12, for example as described in U.S. Pat. No. 3,990,222 of the present applicant, in order to arrange the cops 7 in their doffed position and to receive the empty tubes.

For the doffing and replacement of the cops 7 there is provided, according to the invention, a doffing carriage 13 mobile along the entire machine face and connected lowerly to the roving frame 1 by two bushes 14 slidable on a guide bar 15 extending over the entire length of the machine and projecting at one end therefrom by a certain distance. In its upper part the doffing carriage 13 comprises a frame 16 which terminates upperly in two ledges, a lower ledge 17 carrying two or more guide wheels 18, and an upper ledge 19 carrying a support and guide chain 20 for pneumatic and electrical feed means.

The guide wheels 18 are slidable on a rail 21 extending over the entire machine width and projecting partly from it and supported rigidly by fixed frames 22 which are disposed spaced apart along the machine and also carry a guide case 23 for the chain 20, extending along the machine. The chain 20, formed from preferably plastics links 24, carries compressed air pipes 25 and electric cables 26 for the operation of the doffing carriage 13. One end of the chain 20 is connected to the ledge 19 and the other to the middle of the machine in known manner.

As can be seen, the doffing carriage 13 is situated substantially at the level of the flyer support bed 4 of the roving frame 1. It carries gripping means for the cops 7

Figures 4, 9:
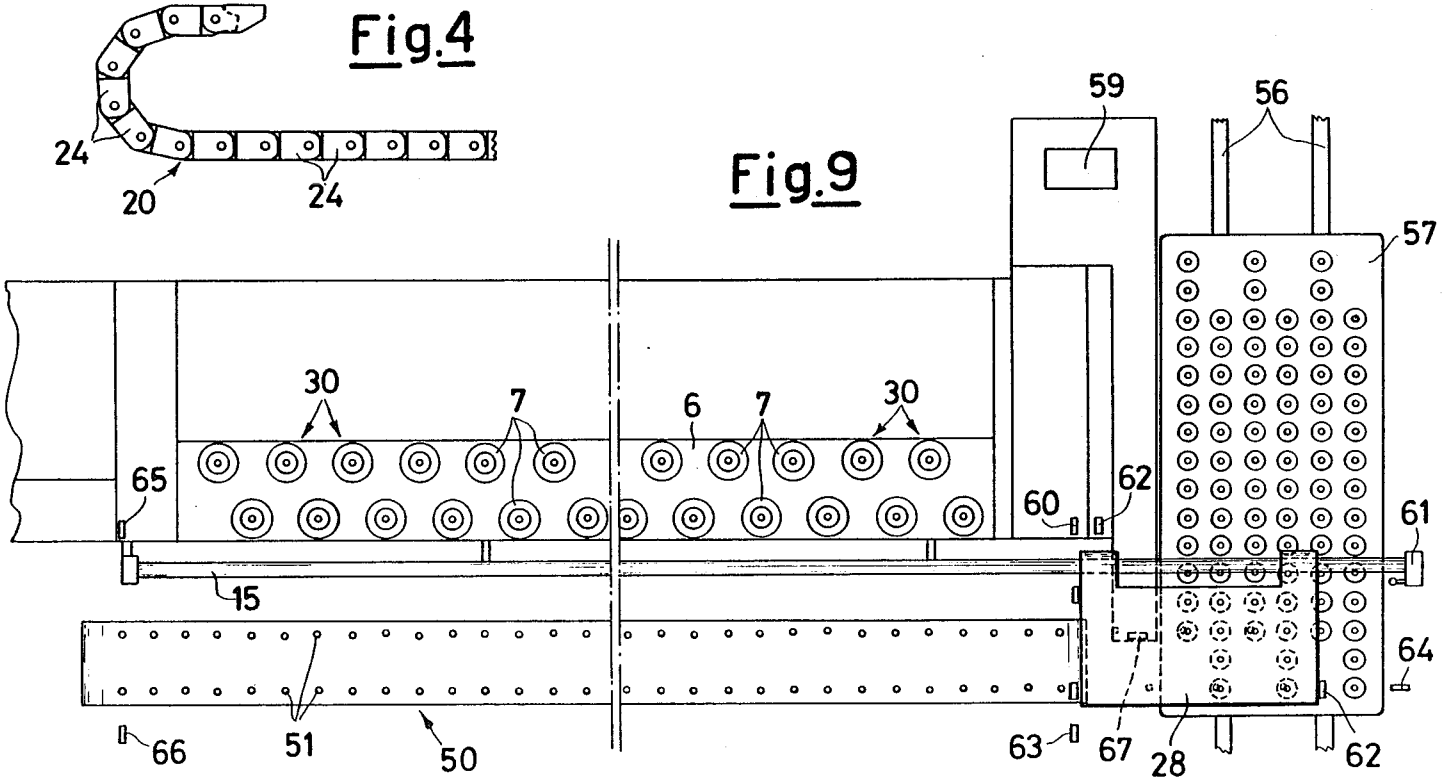
FIG. 4 is a partial view of a support chain for pneumatic and electrical feed means of the doffing carriage.
FIG. 9 is a partly interrupted diagrammatic plan view of the roving frames with the doffing apparatus in its inactive state.

(and for the empty tubes 27 as will be seen hereinafter), comprising a cross-member 28 carrying a plurality of gripping elements 29, for example two, four, six, eight, ten, twelve etc. gripping elements (in the illustrated example they are six in number), disposed zig-zag in two rows spaced apart to the same extent as the working positions 30 on the roving frame 1 (FIG. 9). The gripping elements 29 can advantageously be of the expansion type, in particular as described in U.S. patent application Ser. No. 7,513 of the present applicant.

The cross-member 28 is supported by the rod 31 of the piston of a hydraulic, and in particular pneumatic cylinder 32 extending perpendicular to the cross-member 28 and fixed to a support cross-member 33 carried by two arms 34 pivoted at 35 to the two side faces of the carriage 13.

To the arms 34 there are pivoted at 36 respective rods 37 of hydraulic cylinders 38, these latter being pivoted at 39 to the side walls of the carriage 13 in such a manner as to be able to orientate the arms 34 and thus the entire gripping structure 28–33 through a certain angle to the vertical about a horizontal axis parallel to the axis of orientation of the machine cop carrier 6, as described hereinafter.

Inside the carriage 13 there is mounted a geared motor 40, which by way of a gear transmission 41 rotates a wheel 42 resting on the bar 15 and thus moves the carriage 13 along the roving frame 1. On the carriage 13 there is also mounted a pneumatic positioning cylinder 43, the piston of which has its rod 44 able to penetrate into arresting bores 45 disposed along a fixed part 46 of the machine and spaced apart according to the length of the carriage 13, in order to hold the carriage 13 in an exact position during the doffing and replacment of the cops 7. Along the bed 4 there are mounted, at distances corresponding to the length of the carriage 13, stop cams 47 with which a mobile element 48 of a microswitch 49 fixed to the carriage 13 cooperates, so as to stop the geared motor 40 and operate the positioning element 43 for halting the carriage 13 along the machine in exact transverse alignment with the machine operating positions 30.

In the lower part of the roving frame 1 and extending along it there is disposed a conveyor 50, preferably in the form of articulated elements, which comprises a plurality of pegs 51 disposed in two rows spaced transversely apart by a distance equal to that between the rows of cop rotators (working positions 30 of FIG. 9) and at a longitudinal distance apart equal to one half the longitudinal distance between the axes of adjacent cop rotators. The pegs 51 are therefore disposed with a density double that of the working positions 30. They are shaped to receive both the cops 7 and the empty tubes 27.

The elements of the conveyor 50 slide on a fixed board 52 mounted on supports 53. A geared motor 54 drives one or more rollers 55 for driving the belt of the conveyor 50. In this manner the conveyor 50 is positioned substantially at the level of a machine footboard adjacent to the lowered cop carrier 6.

At one end of the roving frame 1, preferably at the tail end where the bar 15 and rail 21 project, there are provided rails 56 extending perpendicularly to the longitudinal direction of the machine and defining a movement track for container trolleys 57 for the empty tubes 27 and container trolleys 58 for the cops 7. The arrangements is such that when the carriage 13 is in its end position it is able to withdraw the tubes 27 from the container trolleys 57 and deposit the cops 7 in the container trolleys 58. Various sensors are also associated with the machine for determining the various positions of the carriage 13 and of other moving members, and for providing the enabling signals for the doffing and replacement operations, which are described hereinafter with reference to the operational diagrams of FIGS. 12, 13 and 14.

The operation of the apparatus for implementing the method according to the invention can be conveniently divided into three main cycles A, B and C. Cycle A corresponds to the withdrawal of the empty tubes 27 from the container trolley 57 and their depositing on to the pegs 51 of the conveyor 50; cycle B corresponds to the doffing of the cops 7 from the roving frame 1 and their depositing on the conveyor 50 in the spaces which have been left free, ie not previously loaded with empty tubes 27, plus the loading of the empty tubes 27 on to the respective working positions 30 of the roving frame 1; cycle C corresponds to the unloading of the cops 7 from the conveyor 50 and their depositing in the collecting container trolleys 58.

Figure 10:
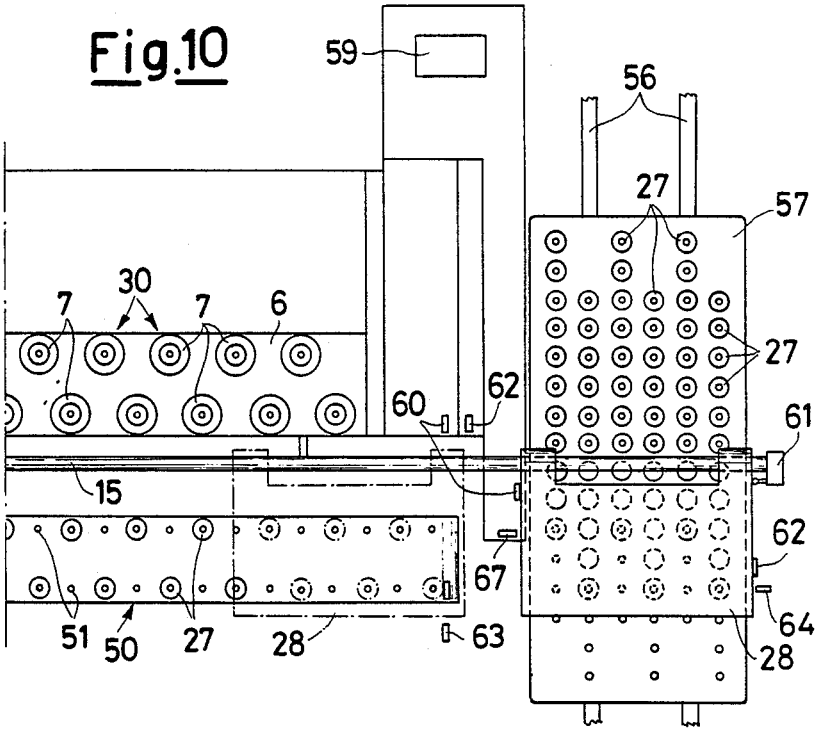
FIG. 10 is a plan view showing the loading of the empty tubes from a container trolley on to the conveyor.
Figure 12:
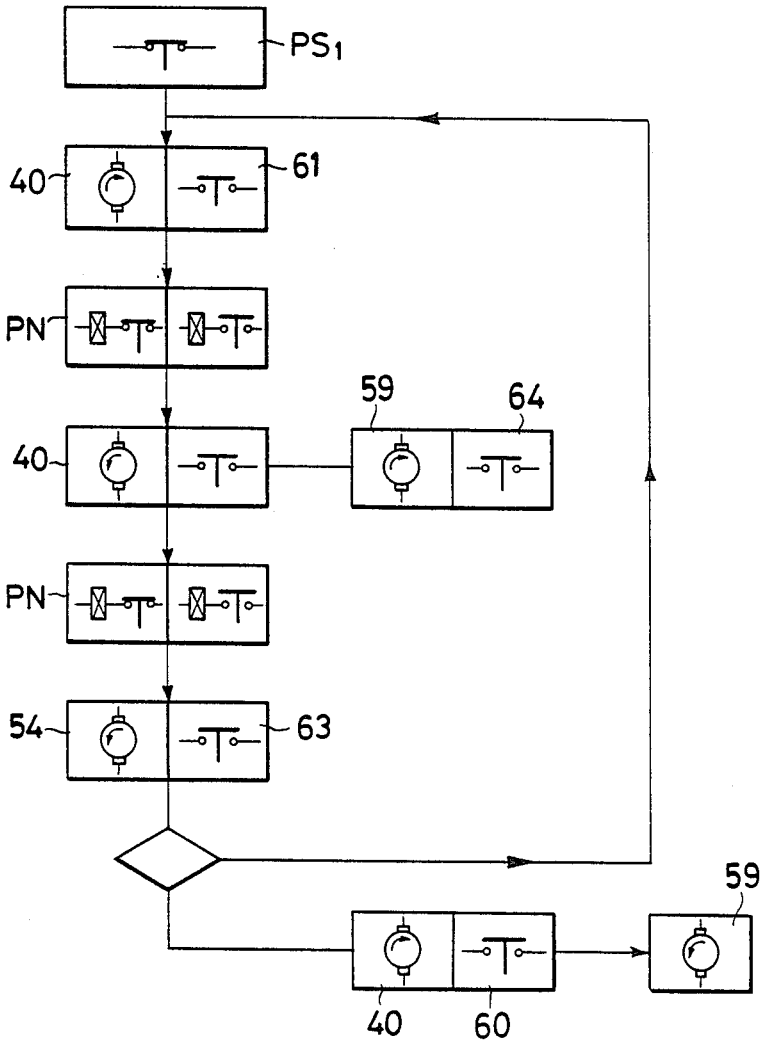
FIG. 12 is a cycle diagram showing the loading of the empty tubes on to the conveyor.

Cycle A (FIGS. 10 and 12)

Before the roving frame 1 has completed the formation of the cops 7, a signal $PS_1$ from the machine control unit starts the geared motor 40 such that the doffing carriage 13, situated at the tail end of the machine (FIG. 9), moves from the rest position defined by the positioning sensor 60 to the gripping position defined by the sensor 61, in which it lies above a container trolley 57 (FIG. 10).

The pneumatic system PN of the carriage 13 now starts. The cylinder 32 lowers the cross-member 28 with the gripping elements 29, which are brought into engagement with a like number of empty tubes 27 previously disposed on pegs of the container trolley 57 in a number of longitudinal rows in the trolley 57 equal to the number of gripping elements 29 of the carriage 13. The engagement can take place by expansion of a yieldable element of the gripping elements inserted into the tubes, as described in the said patent application. The cylinder 32 is then again operated to raise the cross-member 28 and the tubes 27 with it. At this point the geared motor 40 is driven in the reverse direction, such that the carriage 13 becomes transferred above the conveyor 50 into the unloading position defined by the position sensor 62 (position shown by dashed lines in FIG. 10). The pneumatic system PN of the carriage 13 now operates, and by reverse movements to those previously described it deposits the empty tubes 27 on to a like number of pegs 51 of the conveyor 50. It should be noted that because the positions of the pegs 51 on the conveyor belt 50 are in a different density than the positions of the gripping elements 29, only one half of the pegs 51 are engaged by empty tubes 27, leaving alternate pegs 51 free to receive the full cops 7.

When the cross-member 28 has returned to its rest position, the enabling signal is given for advancing the conveyor 50, by means of the geared motor 54 and position sensor 63, through a controlled distance corresponding to that occupied by the tubes 27 which have just been loaded. In the meantime, the motor 59 has driven the carriage 57 through one step (distance between the tubes 27 of each row in the carriage 57) into a new loading position defined by the position sensor 64. The coupling between the motor and carriage can be of various types, easily constructed by an expert of the art. It is however preferably of a type which enables the containers to be moved both forwards and backwards. It should be noted that in the diagram of FIG. 12, the position sensors are shown schematically as electrical contacts, but they can be of different type, for example photoelectric sensors.

The described cycle is repeated analogously until the conveyor 50 has been completely loaded, when the position sensor 63 detects the fact that the conveyor 50 has reached its position of maximum advancement. The carriage 13 is then moved into its rest position defined by the sensor 60, and then waits for the central control unit of the roving frame 1 to feed a signal indicating that the cops 7 have been completely formed and that the cop carrier 6 has been lowered and inclined into an oblique position for withdrawal of the cops 7, as shown in FIG. 1.

Figure 5:
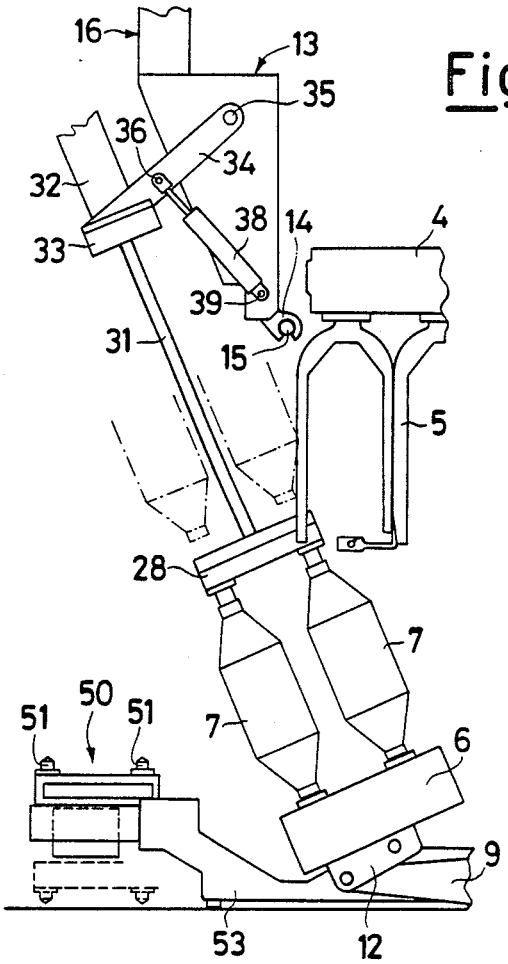
FIGS. 5 and 6 are two diagrammatic side views showing the main stages in the doffing of cops.
Figure 6:
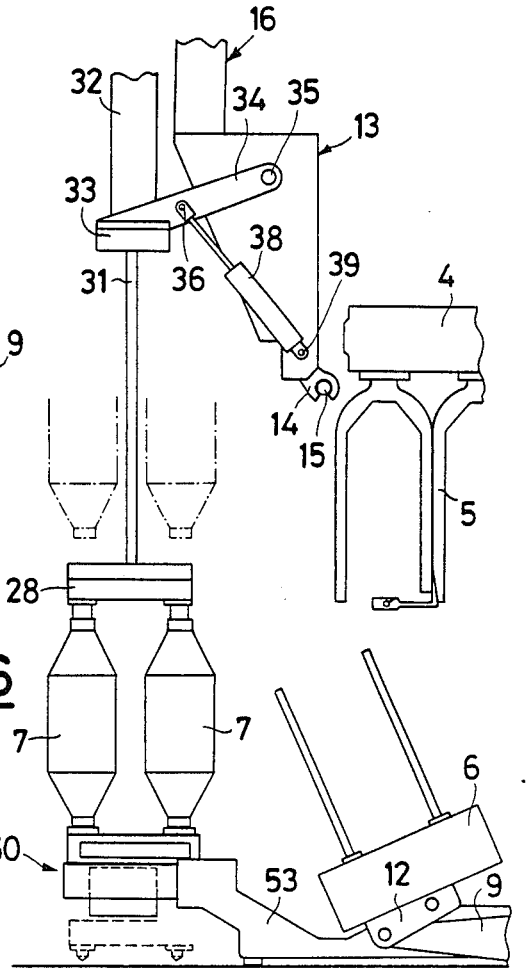
Figure 13:
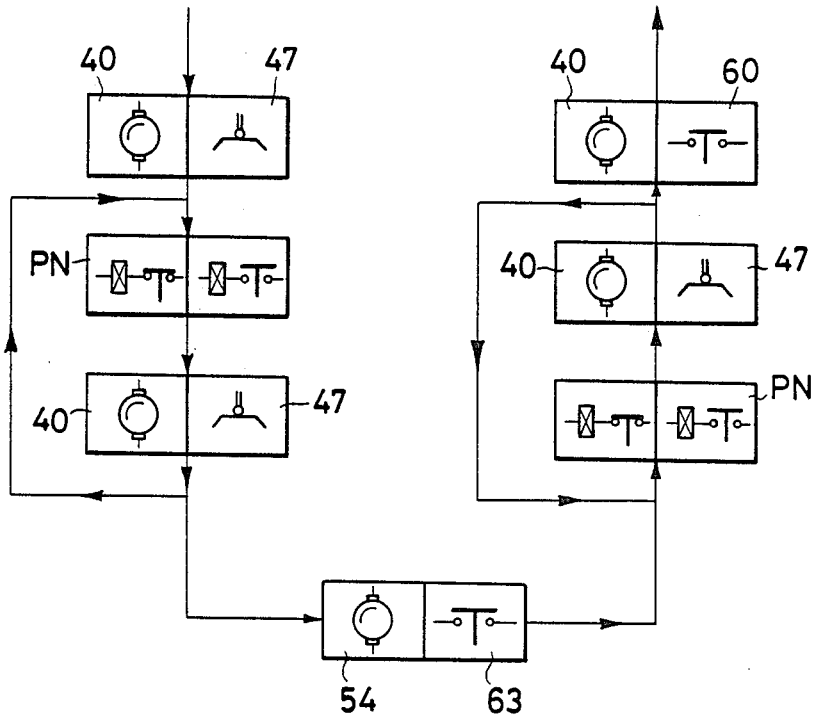
FIG. 13 is a cycle diagram showing the doffing of the cops from the roving frame and the loading of empty tubes on to the roving frame cop rotators.
Figure 14:
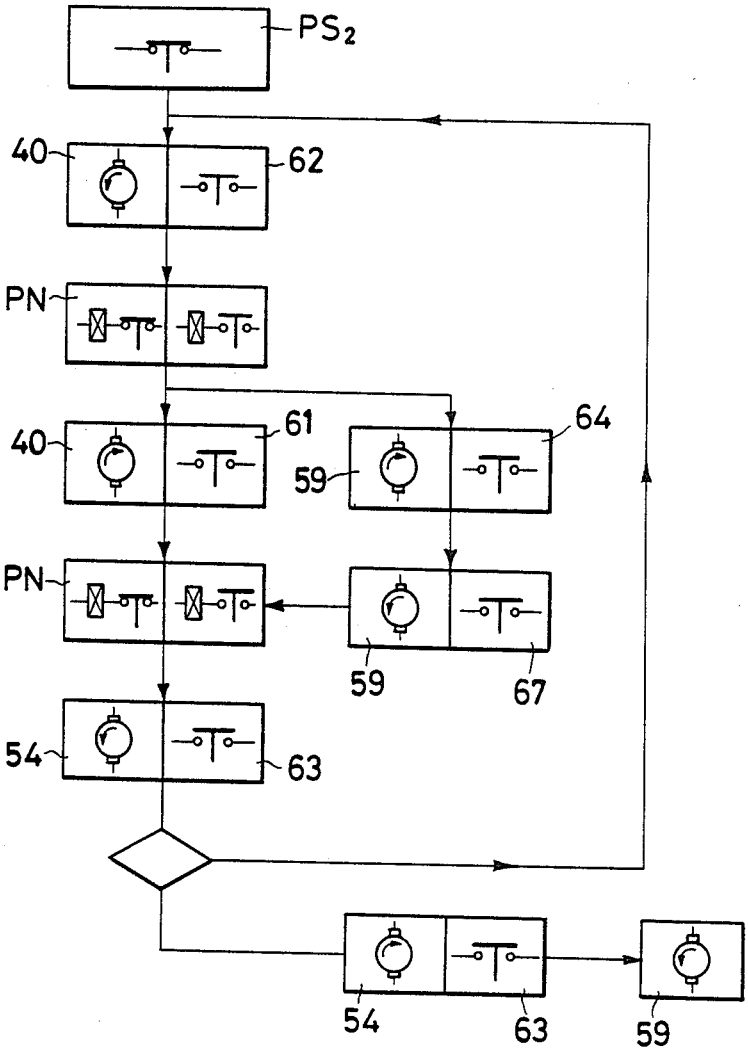
FIG. 14 is a cycle diagram showing the unloading of the cops from the conveyor and into the collecting container trolley.

Cycle B (FIGS. 5, 6, 13)

In order to doff the cops 7, when these are all positioned inclined on the lowered and tilted cop carrier 6 and the machine has stopped, a signal starts the geared motor 40 which moves the doffing carriage 13 from its rest position to its first doffing position defined by the first cam 47 disposed in proximity to the machine tail. When this engages with the mobile element 48 of the microswitch 49, the geared motor 40 is stopped and the piston 44 of the positioning cylinder 43 engaged in a first bore 45, so that the carriage 13 becomes located with its gripping elements 29 exactly at the level of the cops 7, in the longitudinal direction of the roving frame 1.

The pneumatic system PN of the carriage 13 now operates to cause the cylinders 38 to rotate the arms 34 and thus the cross-member 28 with the gripping elements 29 into an inclined position such that the axes of these latter are aligned with the axes of respective cops 7. The piston of the cylinder 32 is now operated to cause the gripping elements 29 to penetrate from above into the upper bores in the tubes of the cops 7 (FIG. 5).

At this point, the gripping elements 29 are made to engage with the inclined cops, and these are raised obliquely by the action of the cylinder 32 (position shown by dashed lines in FIG. 5). The cylinders 38 are now operated until the axes of the cops 7 are aligned with the axes of a like number of underlying pegs 51 (position shown by dashed lines in FIG. 6), after which the cross-member 28 is lowered by the cylinder 32 and the cops 7 are positioned on those pegs 51 of the conveyor 50 which are left free (FIG. 6).

The first operation of the doffing cycle is completed by the subsequent disengagement of the gripping elements 29 from the cops 7 and the further raising of the cross-member 28. The carriage 13 now moves through a distance corresponding to the distance between two cams 47, and a second doffing operation commences identical to the preceding, and so on. The cops 7 are thus taken up in groups along the roving frame 1 proceeding from one end to its other, until the cops 7 are completely loaded on the conveyor 50. The termination of the operation is indicated by the action of the position sensor 65 disposed on the roving frame 1, and which besides determining the end of the doffing cycle causes the conveyor 50 to move through one step (corresponding to the distance between two successive pegs 51 of the conveyor 50), so that the empty tubes 27 now become aligned transversely with the machine working positions 30, from which the cops 7 have just been withdrawn, and aligned vertically with the gripping elements 29 of the doffing carriage 13.

The movement of the conveyor 50 through said step is defined by the position sensor 66, which can advantageously also initiate the slow rotation of the cop rotators, so as to facilitate correct positioning of the empty tubes 27 for example as described in the said U.S. patent application Ser. No. 007,513. It should be noted that no further movement of the conveyor 50 is necessary during the entire loading of the tubes 27, as these are now in their exact alternating state corresponding to that of the cop rotators on the roving frame 1.

Figure 7:
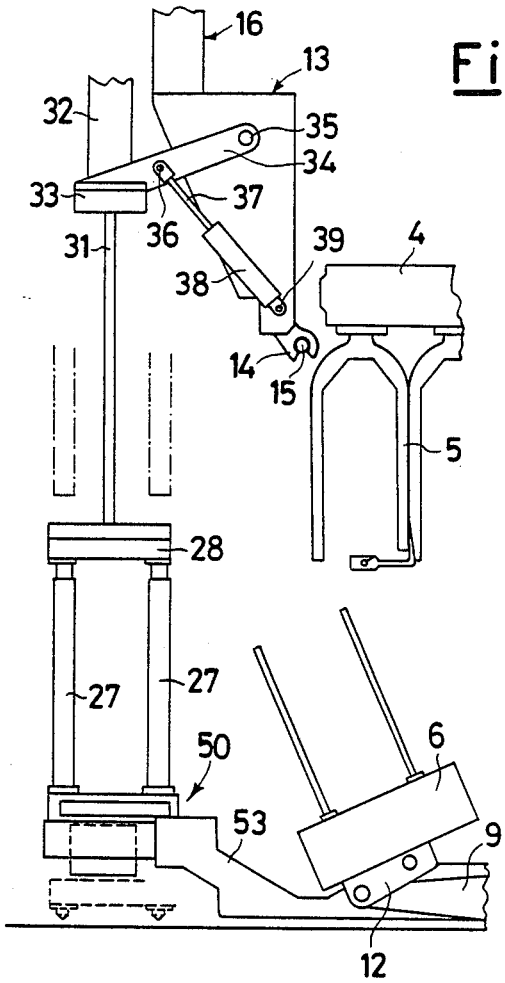
FIGS. 7 and 8 are two diagrammatic side views such as those of FIGS. 5 and 6, but showing the main stages in the loading of empty tubes on to the cop rotators.
Figure 8:
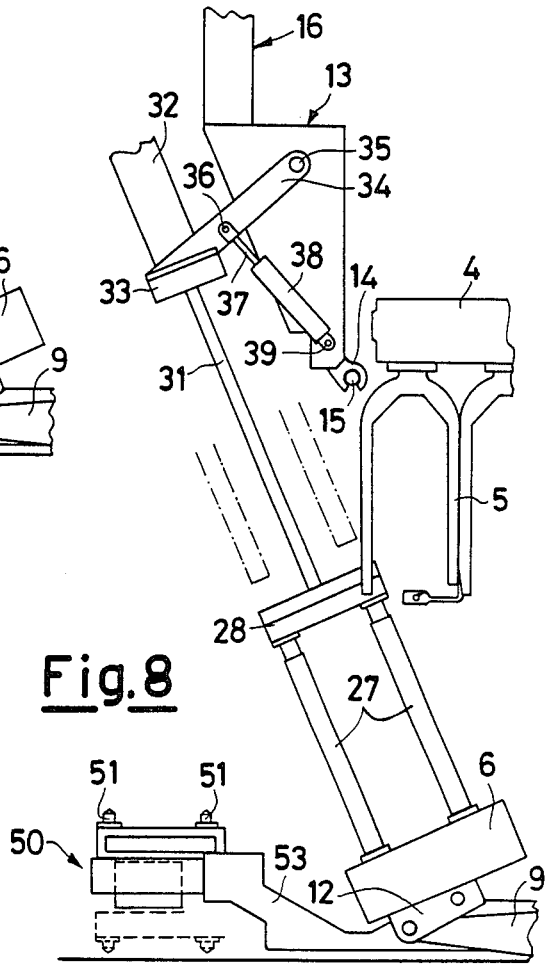

By means of reverse operations to those just described for doffing the cops 7, the empty tubes 27 are now loaded on to the cop rotators by the carriage 13, starting from the head of the machine and working towards the machine tail, ie in the reverse direction to the doffing of the cops 7. The operations are shown in FIGS. 7 and 8 and illustrated diagrammatically in the right hand part of FIG. 13.

When loading has terminated, the carriage 13 is returned to its rest position (sensor 60) and the cop carrier 6 is returned to its upright raised position, so that the machine can be restarted to form a new series of cops 7.

Cycle C (FIGS. 11, 14, 15–18)

After starting the roving frame 1, a signal $PS_2$ from the machine causes the geared motor 40 to move the carriage 13 from its rest position (sensor 60) to the first intervention position above the conveyor 50 (sensor 62), such that the axes of the gripping elements 29 are aligned vertically with those of the cops 7. The pneumatic system PN of the carriage 13 now operates to cause the cylinder 32 to lower the cross-member 28, to insert the gripping elements 29 into the bores in the tubes of the respective cops 7, to engage them with these latter and to then raise the cross-member 28 with the cops 7.

Figure 11:
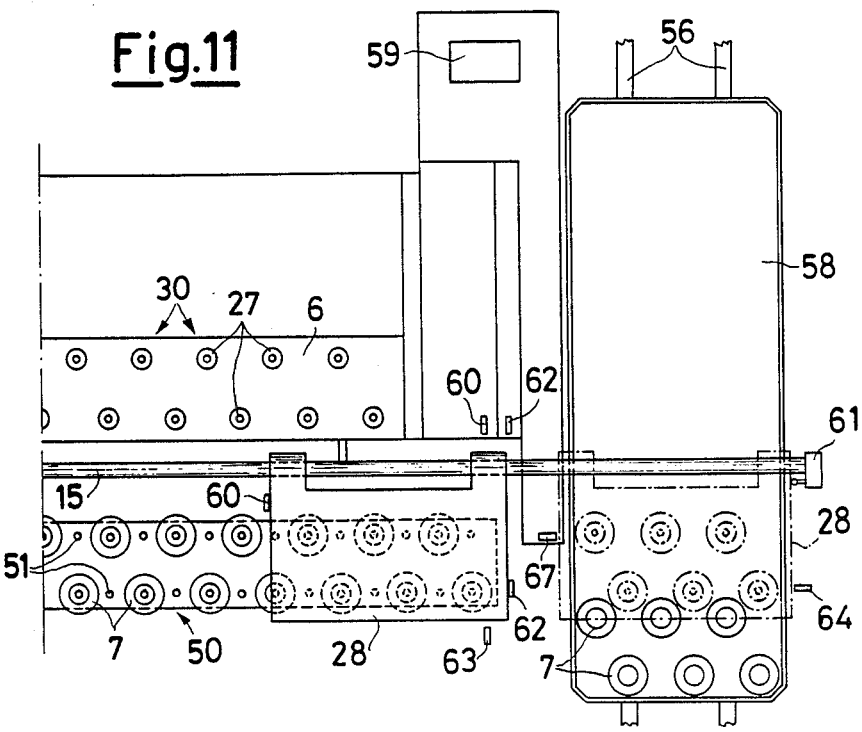
FIG. 11 is a plan view showing the unloading of the cops from the conveyor and into a container trolley.
Figure 15:
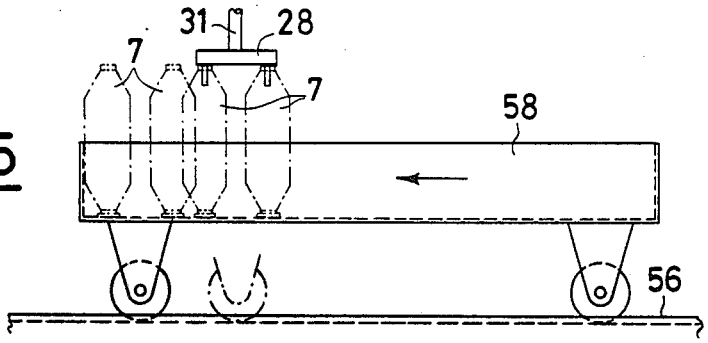
FIGS. 15 and 16 are an elevational and plan view respectively of a first stage in the depositing of the cops in the container trolley.
Figure 16:
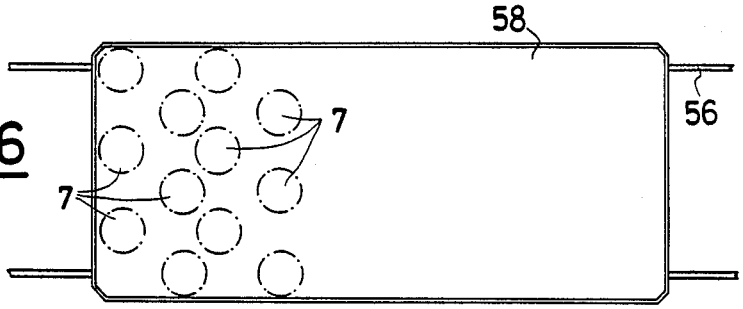
Figure 17:
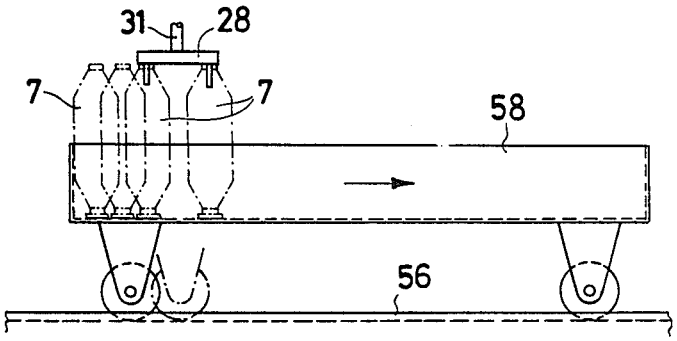
FIGS. 17 and 18 are an elevational and plan view respectively of a second stage in the depositing of the cops in the container trolley.
Figure 18:
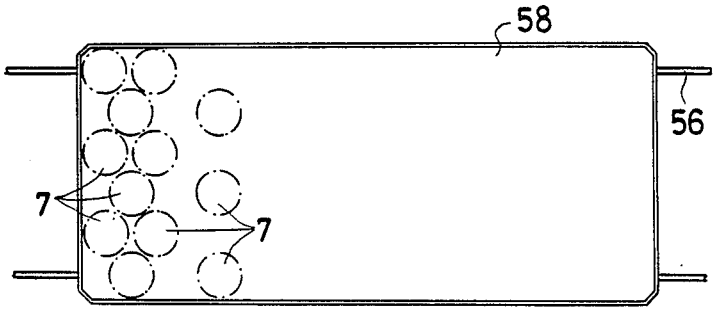

After these operations have been carried out, the doffing carriage 13 moves into its position above the collecting container trolley 58 (sensor 61) which has already been placed on the rails 56. The pneumatic system PN is now operated in the reverse manner to deposit the cops 7 in the trolley 58 (FIGS. 11 and 15, 16). Advantageously, before disengaging the gripping elements 29 from the cops 7, the trolley 58 is moved backwards through a certain distance, for example through 160 mm if the advancement for each loading stage is 320 mm, by the motor 59 controlled by a position sensor 67. In this manner, the cops 7 can be more densely loaded into the container 58, as can be seen from FIGS. 15–18, and the container 58 can contain more cops, for equal dimensions, than those trolleys having positions predetermined by pegs. At this point, the gripping elements 29 are disengaged and raised. Meanwhile, the geared motor 54 is caused to move the conveyor 50 rearwards through a distance corresponding to the distance occupied by the cops 7 which have just been unloaded, this movement being controlled by the sensor 63.

The doffing carriage 13 is now again moved into the cop gripping position (sensor 62) and a new operation of taking up the cops 7 and unloading them into the container 58 takes place as described. The cycle is repeated until the final intervention of the sensor 63, which signals completion of the unloading cycle and the return of the conveyor 50 to its initial position. The trolleys 58 are then removed with the finished cops. The last operation is to return the carriage 13 into its rest position (sensor 60), in which it awaits a new signal $PS_1$ for commencing loading of the empty tubes 27 on to the conveyor 50 (cycle A), and so on.

From the aforegoing description it will be apparent that an apparatus according to the invention does not have the structural complications of the initially described apparatus. It will be noted that the doffing carriage 13 only undergoes limited movements along the machine each time, without having to run through long distances for example for withdrawing cops from one end of the machine to deposit them in the container at the other end. The carriage thus undergoes rational movement without costly time wastage.

As the doffing carriage 13 remains inactive for part of the cop formation cycle, it would be possible to use a single carriage for several machines, by making the carriage mobile on guides pertaining to several machines.

I claim:

1. A method of automatically doffing cops and replacing them with empty tubes in a roving frame, of the type in which the cops are lowered into a position external to flyers and conveyed on to pegs of a conveyor in a zig-zag arrangement, the conveyor then being moved through a certain distance, and the empty tubes, which have been previously loaded on to the conveyor in positions intercalated with the cops, being withdrawn and conveyed on to a lowered cop carrier, the cop carrier then being raised into its working position characterised by the sequential steps of (a) lowering cops with the axes thereof disposed in a generally vertical direction, (b) orienting the lowered cops to position the axes thereof in an oblique direction defining an acute angle to the vertical.

(c) removing the lowered cops from the lowered cop carrier by movement of the cops with the axes thereof generally parallel to the oblique direction, (d) reorienting the removed cops with their axes again disposed in a generally vertical direction, (e) placing the reoriented cops upon the conveyor with the axes thereof disposed in a generally vertical direction, (f) raising empty tubes from the conveyor with the axes thereof disposed in a generally vertical direction, (g) orienting the raised empty tubes to position the axes thereof in an oblique direction defining an acute angle to the vertical, (h) placing the obliquely oriented empty tubes upon the lowered cop carrier by movement of the empty tubes with the axes thereof generally parallel to the oblique direction, and (i) re orienting empty tubes with their axes again disposed in a generally vertical direction.

2. A method as claimed in claim 1, characterised in that the cops are withdrawn in groups along the roving frame proceeding from one end to the other thereof.

3. A method as claimed in claim 2, characterised in that the empty tubes are loaded in groups on to the roving frame proceeding in the opposite direction to that of cop withdrawal.

4. A method as claimed in claim 1, characterised in that the empty tubes are loaded in groups on to the roving frame proceeding in the opposite direction to that of cop withdrawal.

5. A method as claimed in claim 1, characterised in that the empty tubes are orientated into a vertical position simultaneously along the entire roving frame after loading.

6. A method as claimed in claim 1, characterised in that the cops and empty tubes are engaged from above the doffing and loading operations.

7. A method as claimed in claim 1, characterised in that the empty tubes are loaded in groups on to the conveyor at one end of the roving frame, and the conveyor is advanced in steps between one loading stage and the next.

8. A method as claimed in claim 7, characterised in that the cops unloaded from the conveyor are deposited in a mobile collection container, which is moved backwards through a certain distance, to allow denser cop deposition, before they are released by the gripping means.

9. A method as claimed in claim 1, characterised in that the cops are unloaded in groups from the conveyor at one end of the roving frame, and the conveyor is advanced in steps between one unloading stage and the next.

10. A method as claimed in claim 1, characterised in that the loading of the empty tubes on to the conveyor and the unloading of the cops from the conveyor take place with the roving frame in operation.

11. A method as claimed in claim 1, characterised in that the cops unloaded from the conveyor are deposited in a mobile collection container, which is moved backwards through a certain distance, to allow denser cop deposition, before they are released.

12. A method as claimed in claim 1, characterised in that the empty tubes and the cops are withdrawn from, and respectively deposited in, container trolleys mobile perpendicular to the longitudinal extension of the roving frame.

13. A method as claimed in claim 1, characterised in that the cops are oriented in to an oblique direction simultaneously along the entire roving frame before doffing.

14. An apparatus for automatically doffing cops and replacing them with empty tubes, comprising a device for gripping and conveying the cops and tubes relative to a roving frame, a conveyor for receiving the cops and the empty tubes in respective intercalated zig-zag arrangements, means for lowering a cop carrier to the outside of associated flyers of a flyer support bed into a position in which the cops are gripped, means for the programmed movement of the conveyor, a cop and tube gripping device including a doffing carriage mobile along the face of the roving frame substantially at the level of the flyer support bed, and a plurality of means for sequentially (a) lowering cops with the axes thereof disposed in a generally vertical direction, (b) orienting the lowered cops to position the axes thereof in an oblique direction defining an acute angle to the vertical, (c) removing the lowered cops from the lowered cop carrier by movement of the cops with the axes thereof generally parallel to the oblique direction, (d) reorienting the removed cops with their axes again disposed in a generally vertical direction, (e) placing the reoriented cops upon the conveyor with the axes thereof disposed in a generally vertical direction, (f) raising empty tubes from the conveyor with the axes thereof disposed in a generally vertical direction, (g) orienting the raised empty tubes to position the axes thereof in an oblique direction defining an acute angle to the vertical, (h) placing the obliquely oriented empty tubes upon the lowered cop carrier by movement of the empty tubes with the axes thereof generally parallel to the oblique direction, and (i) reorienting the empty tubes with their axes again disposed in a generally vertical direction.

15. An apparatus as claimed in claim 12, characterised in that the doffing carriage comprises a cross-member carrying a plurality of gripping elements for the cops and tubes, the crossmember being raisable and lowerable and also orientatable about a horizontal axis parallel to an axis of orientation of the cop carrier.

16. An apparatus as claimed in claim 15, characterised in that the gripping elements on the doffing carriage are disposed in a zig-zag arrangement.

17. An apparatus as claimed in claim 16 characterised in that the gripping elements comprise expandable engagement means insertable into the bores in the cops and empty tubes.

18. An apparatus as claimed in claim 15, characterised in that hydraulic means are associated with the cross-member for its raising and lowering movement and orientation, and for operating the gripping elements.

19. An apparatus as claimed in claim 18 characterised in that the gripping elements comprise expandable engagement means insertable into the bores in the cops and empty tubes.

20. An apparatus as claimed in claim 15, characterised in that the gripping elements comprise expandable engagement means insertable into the bores in the cops and empty tubes.

21. An apparatus as claimed in claim 15, characterised in that the cross-member carrying the gripping elements is supported by the rod of the piston of a hydraulic cylinder carried by a support cross-member, this support cross-member being fixed to arms pivoted to the frame of the doffing carriage for its orientation about said horizontal axis.

22. An apparatus as claimed in claim 14, characterised in that the doffing carriage is mobile on guides extending in the longitudinal direction of the machine and beyond the machine at least at one end thereof.

23. An apparatus as claimed in claim 22, characterised in that at the projecting part of the guide a track is defined for the movement of trolleys for containing cops and empty tubes, and extends perpendicular to the guides.

24. An apparatus as claimed in claim 14, characterised in that the doffing carriage is mobile on guides pertaining to several machines.

25. An apparatus as claimed in claim 14, characterised in that means are associated with the doffing carriage for halting it in predetermined positions along the roving frame.

* * * * *